United States Patent [19]

Busch

[11] 4,182,539

[45] Jan. 8, 1980

[54] LATCHING DEVICE

[75] Inventor: Richard E. Busch, La Puente, Calif.

[73] Assignee: Addmaster Corporation, San Gabriel, Calif.

[21] Appl. No.: 895,242

[22] Filed: Apr. 10, 1978

[51] Int. Cl.[2] ..... A47B 88/04; A47B 88/16

[52] U.S. Cl. ..... 312/333; 292/110; 292/DIG. 49; 312/319; 235/22

[58] Field of Search ..... 312/333, 319, 320, 220, 312/221, 222; 235/22; 292/110, 64, DIG. 49

[56] References Cited

U.S. PATENT DOCUMENTS

| | | | |
|---|---|---|---|
| 434,584 | 8/1890 | Drew | 235/22 |
| 2,070,064 | 2/1937 | Pasinski | 312/319 |
| 3,973,814 | 8/1976 | Entrikin | 312/333 |
| 4,066,308 | 1/1978 | Wedel | 312/333 |

*Primary Examiner*—Mervin Stein
*Assistant Examiner*—Alexander Grosz
*Attorney, Agent, or Firm*—Fred N. Schwend

[57] ABSTRACT

A cash register drawer releasing device wherein the drawer latch is pivotally supported for movement to unlatching position, but normally blocked from such movement by a toggle device which may be released by a relatively weak electromagnet.

9 Claims, 1 Drawing Figure

FIG.1.
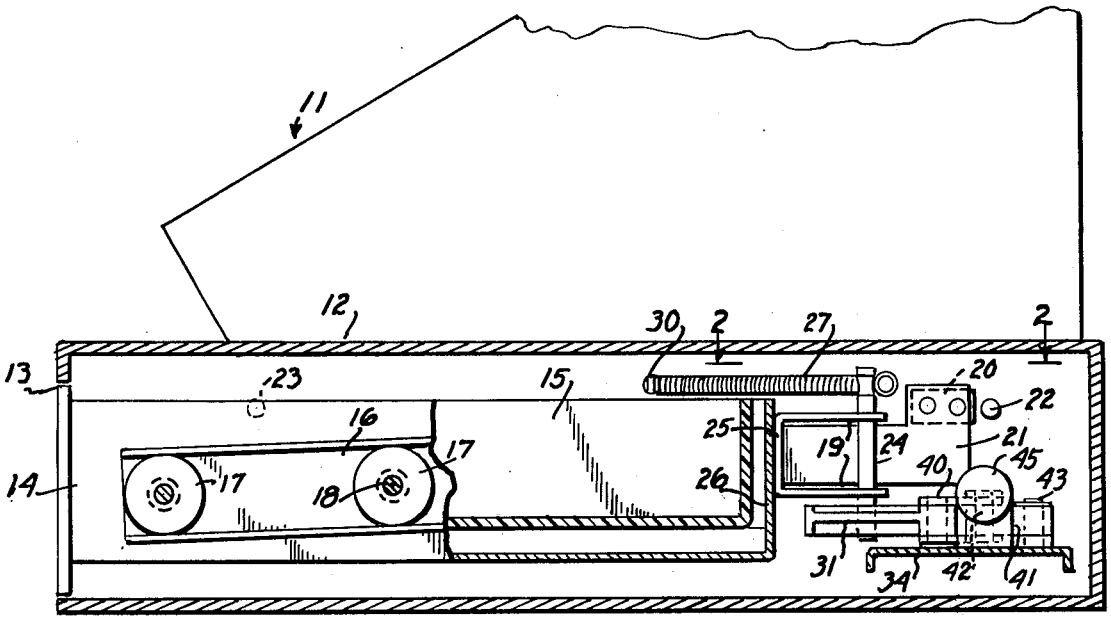
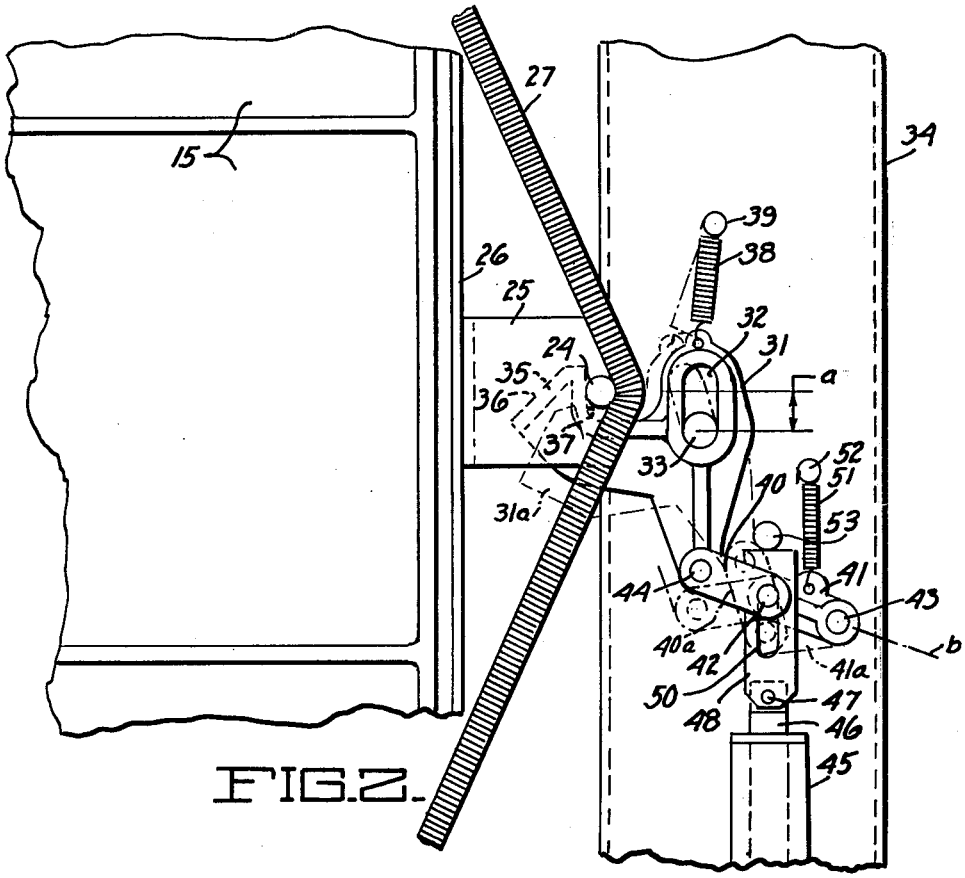
FIG.2.

LATCHING DEVICE

BACKGROUND OF THE INVENTION

1. Field of the Invention

This invention relates to cash registers and has particular reference to apparatus for releasing a cash drawer of a latching device from closed position.

2. Description of the Prior Art

Cash register drawers are generally latched in closed position against the action of a drawer opening spring and are unlatched as an incident to operation of the register. Since such cash drawers are generally relatively heavy and may, in addition, be heavily weighted with coins, etc., relatively strong springs must be provided to move the drawer from closed to open position upon release of the latching mechanism therefor. Because of this, considerable force must generally be exerted to operate the latching mechanism due to the frictional forces existing between the latching mechanism and the drawer. Thus, in cases where it is desired to employ an electromagnetic latch release mechanism, controlled either from the cash register or remotely therefrom, relatively large and powerful electromagnetic devices must be provided. Such devices are expensive, take up valuable space, and increase the overall weight of the register, as well as requiring considerable electrical current for operation.

SUMMARY OF THE INVENTION

A principal object of the present invention is to provide a cash drawer release mechanism which requires only a small amount of force to operate the same regardless of the strength of the drawer opening spring.

Another object is to provide an electromagnetically operated cash drawer release mechanism which is compact, inexpensive, and of light weight.

A further object is to provide an electrically operated cash drawer release mechanism which requires only a small amount of electrical current for operation.

According to the present invention, a cash drawer release device is provided comprising a latch which is supported for both pivotal and sliding movement between drawer latching and unlatching positions. A toggle type blocking means normally blocks the latch from pivoting to unlatching position under the influence of the drawer opening spring. Such toggle is releasable by a very light actuating force. The toggle is ineffective, however, to block sliding movement of the latch by the cash drawer upon movement to closed position, in order to relatch the drawer.

BRIEF DESCRIPTION OF THE DRAWING

The manner in which the above and other objects of the invention are accomplished will be readily understood on reference to the following specification when read in conjunction with the accompanying drawing, when:

FIG. 1 is a sectional side elevational view illustrating a cash register and cash drawer embodying a preferred form of the present invention.

FIG. 2 is an enlarged sectional plan view taken along the line 2—2 of FIG. 1.

BRIEF DESCRIPTION OF THE DRAWINGS

While this invention is susceptible to embodiment in many different forms, there is shown in the drawing and will be described in detail one specific embodiment, with the understanding that the present disclosure is to be considered as an exemplification of the principles of the invention and is not intended to limit the invention to the particular embodiment illustrated. Also, the invention may be embodied in cash registers of many different configurations.

Referring to the drawing, the cash register, generally indicated at 11, is mounted on a cash drawer housing 12 having an opening 13 at the forward end thereof to receive a cash drawer 14. The latter is divided into compartments 15 to receive money of different denominations, and carries channel rails on opposite sides thereof, one of which is shown at 16, which ride over rollers 17 rotatably mounted on bearing studs 18 fixed to the side walls of the drawer housing 12 to guide the drawer 14 between its illustrated rear, closed or inaccessible position to a forward, open or accessible position relative to the drawer housing 12.

The rails 16 preferably incline downwardly toward the front of the drawer 14, causing the downward force induced by gravity to aid the spring 27 in moving the drawer forwardly. Thus, the heavier the drawer is loaded with coins, etc., the greater will be the tendency for the drawer to move forwardly in spite of the additional frictional resistance between the rollers 17 and their bearing studs 18, resulting from the added weight. By selecting an appropriate angle of incline for the particular frictional characteristics of the rollers 17 and their bearing studs, the resistance to forward movement of the drawer can be made substantially constant regardless of any differential loading of the drawer.

An elastomeric bumper 20 is secured to a rearwardly extensing bracket 21 on the drawer 14 and is engagable with a frame stud 22 extending from the side wall of the drawer housing 12 to limit rearward movement of the drawer. The bumper 20 is also engagable with a second frame stud 23 extending from the side wall of the drawer housing to limit forward movement of the drawer.

Spring means are provided to impel the drawer 14 forwardly to its open position when released to do so. For this purpose, a vertical pin 24, forming part of the cash drawer, is suitably secured to vertically spaced legs 19 of a U-shaped bracket 25 suitably secured to the rear wall 26 of the drawer 14. A relatively strong tension spring 27 extends across the drawer housing 12 and is secured at its opposite ends to the opposite side walls of the housing 12, as indicated at 30. Normally, when the drawer is in its closed position, the spring 27 is tensioned over the upper end of the pin 24, as seen in FIG. 2, thereby urging the drawer forwardly.

According to the present invention, a latch 31 is provided having an elongate slot 32 therein which pivotally and slidably embraces a fixed pivot stud or pin 33 extending upwardly from a cross brace 34 which extends across drawer housing 12 and is suitably secured to the side walls of the latter. A latching nose 35 having an inclined forward camming shoulder 36 and a latching shoulder 37 thereon is formed on the latch 31 to engage the aforementioned drawer pin 24. A spring 38 is tensioned between the latch 31 and a frame pin 39 upstanding from the cross brace 34 to normally hold the latch in its uppermost latching position shown in FIG. 2 wherein the shoulder 37 is located in latching engagement with the pin 24. It will be noted that, when the latch 31 is in its illustrated latching position, the center of pin 24 is located at a distance "a" from the center of the pin 33, as measured across planes extending parallel to the direction of movement of the drawer 14, to establish a moment arm tending to pivot the latch in a counterclockwise direction about pin 33 against the action of spring 38 to unlatch the drawer. However, this movement is normally blocked by a toggle device comprising links 40 and 41 pivoted together by a pivot pin 42. The link 41 is fulcrumed on a fixed pin 43 upstanding from the cross brace 34 and the link 40 is pivoted at 44 to the latch 31.

A relatively small and inexpensive solenoid 45 is suitably fixedly supported on the cross brace 34 and its armature 46 is pivotally connected at 47 to a slide 48 having an elongate slot 50 therein which slideably embraces the pin 42 interconnecting the links 40 and 41.

A light spring 51 is tensioned between the link 41 and a fixed stud 52 to normally hold the links 41 and 42 in their illustrated straight-line extended positions and with the slide 48 engaging a fixed stop pin 53 upstanding from the cross brace 34. In such position, the centers of the pins 42, 43, and 44 are located in a common plane "b," thus forming a blocking device to prevent the latch 31 from being rocked counterclockwise about pin 33 toward its unlatching position shown by the dot-dash line 31*a* by the action of pin 24 against the latch.

Since the latch shoulder 37 of latch 31 extends parallel to the length of slot 32, there is no existent force tending to bodily slide the latch 31 along the length of the slot 32. Therefore, the latter will be normally held in latching condition.

When the solenoid 45 is energized, the slide 48 will pull against the pin 42, thereby overcoming the force of the light spring 51 and causing the links 40 and 41 to "break." That is, the pin 42 will pass out of the plane "b," permitting the spring 27 to overcome the force of spring 38 to rock the latch 31 counterclockwise and cause the links 40 and 41 to assume their collapsed positions indicated at 40*a* and 41*a*, respectively. Thus, the spring 27 will be free to impel the drawer 14 forwardly to open position.

It will be noted that solenoid 45 need only be momentarily energized and thereafter the latch 31 will move under the impetus of spring 27, causing the pivot pin 42 to ride along the length of the elongate slot 50 in slide 48. Thus, the latch 31 will be rocked sufficiently to permit the pin 24 to pass the latching nose 35, even though the solenoid 45 may be de-energized before that occurs.

After release of the drawer 14 from its latched position, the spring 38 will return the latch 31 clockwise to its normal latching position and the links 40 and 41 will assume their blocking relation to the latch. Now, when the drawer 14 is manually or otherwise returned to its illustrated closed position, the pin 24 will engage the inclined camming shoulder 36 of latch 31 and will bodily cam the latch toward the solenoid 45 against the action of spring 38. Hence, during this movement, the pin 42 will be retained in its full line position shown in FIG. 2 by spring 51 and the link 40 will merely swing about pin 42 until the pin 24 passes the latching shoulder 37, at which time the spring 38 will return the latch to its illustrated latching position.

I claim:

1. A latching device for latching first and second members in a predetermined relationship against a first spring tending to move said first member out of said relationship relative to said second member, comprising a latch, support means supporting said latch for pivotal movement about an axis, said latch having a latching shoulder engagable with said first member at a location offset from a line extending in the direction of movement of said first member and passing through said axis to latch said first member, said first spring urging said first member to pivot said latch to unlatch said first member, blocking means releasably blocking said latch from pivoting, said support means supporting said latch for bodily sliding movement in a first direction to latch said first member and in an opposite direction to unlatch said first member, a second spring urging said latch in said first direction, said first member being effective upon movement into said predetermined relationship to bodily slide said latch in said opposite direction and to thereafter enable said second spring to bodily slide said latch in said first direction to latch said first member, and means for causing said blocking means to unblock said latch.

2. A latching device as defined in claim 1 wherein said blocking means comprises a toggle device movable between uncollapsed and collapsed conditions, means normally maintaining said toggle device in said uncollapsed condition whereby to block said latch from unlatching said first member, and means for moving said toggle device toward said collapsed condition whereby to allow said first spring to cause said first member to pivot said latch to unlatch said first member.

3. A latching device as defined in claim 1 wherein said blocking means comprises a pair of interconnected links, said pair being pivotally connected at one end to said latch and fulcrumed at the opposite end thereof, a third spring normally holding said links in substantially coextensive relation to each other whereby to block said latch from one latching said first member, and means for moving said links from said coextensive relation whereby to allow first spring to cause said first member to pivot said latch to unlatch said first member.

4. In a cash register having a housing, a cash drawer movable between accessible and inaccessible positions relative to said housing, and first spring meansurging said drawer toward said accessible position:

a latching device for releasably latching said drawer in said inaccessible position comprising;

a latch, support means supporting said latch for pivotal movement about an axis, said latch having a latching shoulder engagable with said drawer at a location offset from a line extending in the direction of movement of said drawer and passing through said axis to latch said drawer, said first spring means urging said drawer to pivot said latch to unlatch said drawer, blocking means releasably blocking said latch from pivoting, said support means supporting said latch for bodily sliding movement in a first direction to lock said drawer and in an opposite direction to unlatch said drawer, second spring means urging said latch in said first direction, said drawer being effective upon movement from said accessible position to said inaccessible position to bodily slide said latch in said opposite direction and to thereafter enable said second spring means to bodily slide said latch in said first direction to latch said drawer, and means for causing said blocking means to unblock said latch.

5. A latching device as defined in claim 1 wherein said latch comprises a camming surface engagable by said drawer upon movement of said drawer from said accessible position to said inaccessible position to slide said bodily in said first direction while said blocking means blocks said latch from pivoting.

6. A latching device as defined in claim 1 wherein said blocking means comprises a toggle device moveable between uncollapsed and collapsed conditions, means normally maintaining said toggle device in said uncollapsed condition whereby to block said latch from unlatching said drawer, means for moving said toggle device toward said collapsed condition whereby to allow said first mentioned spring means to cause said drawer to pivot said latch to unlatch said drawer,

7. A latching device as defined in claim 1 wherein said blocking means comprises a toggle device moveable between collapsed and uncollapsed conditions, third spring means normally maintaining said toggle device in said uncollapsed condition whereby to block said latch from unlatching said drawer, and means for moving said toggle device toward said collapsed condition whereby to allow said first spring means to cause said drawer to pivot said latch to unlatch said drawer, said third spring means being effective to move said toggle device to said uncollapsed condition upon movement of said drawer to said inaccessible position.

8. A latching device as defined in claim 1 or claim 4 wherein said blocking means comprises a pair of interconnected links, said pair being pivotally connected at one end to said latch and fulcrumed at the opposite end thereof, third spring means normally holding said links in coextensive relation to each other whereby to block said latch from unlatching said drawer, and means for moving said links from said coextensive relation whereby to allow said first spring means to cause said drawer to pivot said latch to unlatch said drawer.

9. In a cash register having a housing, a cash drawer movable between accessible and inaccessible positions relative to said housing, and first spring means urging said drawer toward said accessible position;

a latching device for releasably latching said drawer in said inaccessible position comprising:

a latch, a combined sliding and pivotal support for said latch, said support supporting said latch for pivotal movement to latch and unlatch said drawer, said support supporting said latch for sliding movement in a first direction to latch said drawer and in the opposite direction to unlatch said drawer, second spring means for urging said latch in said first direction, said first spring means urging said drawer to pivot said latch to unlatch said drawer, blocking means for blocking said latch from said pivotal movement, said blocking means comprising a pair of interpivoted toggle links movable between collapsed and uncollapsed conditions, means pivotally connecting said pair at one end thereof to said latch, fulcrum means at the opposite end of said pair for pivotally supporting said pair for swinging movement toward and away from said latch support, third spring means normally maintaining said links in said uncollapsed condition whereby to prevent said latch from said pivotal movement, and means for collapsing said links whereby to allow said first spring means to cause said drawer to pivot said latch to unlatch said drawer, said drawer being effective upon movement from said accessible position to said inaccessible position to slide said latch in said opposite direction and to thereafter enable said second spring means to slide said latch in said first direction to latch said drawer.

* * * * *